United States Patent [19]

Hindrichs et al.

[11] Patent Number: 5,038,867

[45] Date of Patent: Aug. 13, 1991

[54] FIRE PROTECTION OF CARGO SPACES

[75] Inventors: Holger Hindrichs, Bremen; Eckhard Koch, Lilienthal; Heiko Trey, Bremen, all of Fed. Rep. of Germany

[73] Assignee: MBB, Bremen, Fed. Rep. of Germany

[21] Appl. No.: 47,027

[22] Filed: May 6, 1987

[30] Foreign Application Priority Data

May 7, 1986 [DE] Fed. Rep. of Germany ..... 3615415

[51] Int. Cl.[5] ..... A62C 35/12

[52] U.S. Cl. ..... 169/62; 244/129.2

[58] Field of Search ..... 169/62, 46, 47, 57, 169/5, 16, 66, 68, 70; 244/129.2

[56] References Cited

U.S. PATENT DOCUMENTS 4,351,394 9/1982 Enk ..... 169/62 X
4,566,542 1/1986 Enk et al. ..... 169/62
4,643,260 2/1987 Miller ..... 169/62 X
4,726,426 2/1988 Miller .

FOREIGN PATENT DOCUMENTS 971365 11/1982 U.S.S.R. ..... 169/62

*Primary Examiner*—Sherman Basinger
*Assistant Examiner*—Stephen P. Avila
*Attorney, Agent, or Firm*—Ralf H. Siegemund

[57] ABSTRACT

Fire protection equipment for estinguishing fires in the cargo space of an aircraft includes two containers for extinguishing evaporating liquid; a common conduit system with nozzles distributes the liquid and is directly connected to one of the containers; the other container is also connected to that conduit system but through a series connection of a water adsorption filter, a solid particle filter, a pressure reducing stage, and a throttle to establish a constant flow rate from the second container into the conduit system, a check valve prevents back flow into the latter container.

4 Claims, 4 Drawing Sheets

FIRE PROTECTION OF CARGO SPACES

BACKGROUND OF THE INVENTION

The present invention relates to fire protection and extinguishing a fire in the freight and cargo space of vehicles, particularly the baggage and freight compartment(s) of an aircraft.

It is well known that aircraft, particularly commercial aircraft, are constructed to be operated either as passenger carrying vehicles, or as freight and cargo carriers or in some kind of hybrid configuration. Passenger planes, include, of course, passenger and pilot compartment in upper decks and, in addition certain space is set aside basically for baggage but which can also be used as cargo space for air freight. This baggage compartment or bulk of the aircraft is usually in a lower deck, and is constructed, particularly for large aircraft, in that the freight and baggage is placed in containers and the containers are shifted in and out of the aircraft. Usually, this freight and baggage compartment is situated underneath the passenger compartment in regular aircraft, operated basically as passenger carrying vehicles, but in other, hybrid cases, the tail portion of the aircraft holds also baggage.

In case a fire develops somwhere in any of these cargo spaces and compartments, the principle object is to prevent the spreading of the fire, and for this fire extinguishing equipment is known and used which basically is comprised of two completely separated fire extinguishing systems, each with its own network of distributing conduits. The first one of these two fire extinguishing systems responds directly and immediately upon a signaling of smoke, and the containers for a fire extinguishing medium, being under atmospheric pressure and pressurized accordingly, will immediately and directly empty this medium fully into the particular cargo space. The rapid emptying of these containers causes a high concentration of fire extinguishing medium within the freight and cargo space so that, hopefully, the then existing fire is rapidly extinguished. The second fire extinguishing system is provided to make sure that subsequently during the remainder of the flight, the concentration of fire extinguishing material in the freight space will not drop below a particular limit. The second fire extinguishing system includes a conduit network which is provided with discharge nozzles for the fire extinguishing medium, and solid particle filters as well as extinguishing gas dryer are provided close to these nozzles. The nozzles generally are controlled to provide a relatively slow rate of flow of fire extinguishing medium, particularly at a constant rate, so as to maintain the status quo.

It is quite apparent that the second fire extinguishing equipment operates on a relatively long term basis. It was found that occasionally icing may occur, particularly in the cleaning, filtering, and metering equipment. This icing over occurs on account of the evaporation process of the emerging fire extinguishing medium which evaporation produces a very drastic drop in temperature of the joining equipment. This icing over may, in fact, render it time the second extinguishing system inoperative. Relevant prior art includes U.S. Pat. No. 4,566,542, as well as fire extinguishing equipment, e.g. for the Boeing 767 aircraft.

DESCRIPTION OF THE INVENTION

It is an object of the present invention to provide a new and improved fire protection and extinguishing equipment for the freight and cargo space in vehicles, particularly aircraft, but avoiding the danger of icing and, therefore, avoiding the danger of failure of the second fire extinguishing equipment which is to maintain a safe status quo until the plane can safely land.

It is a feature of the present invention to maintain the principle of dual fire extinguishing phases but to provide a common conduit system for both kinds of fire extinguishing operation of the type described.

In accordance with the preferred embodiment of the present invention, it is, therefor, suggested to provide at least two containers for a fire extinguishing medium, which medium is gaseous under atmospheric pressure, and that a common network of conduits, including common nozzles for both phases are provided in the cargo space of an aircraft, for ejecting fire extinguishing medium into that space, however, for purposes of reducing the rate of medium expulsion from the second container, and for preventing icing of the conduits, and of the nozzles, a water absorption filter, a solid particle filter, a pressure reducing valve, throttles, and check valves are placed directly downstream from the second container, upstream from conduit merger of the common system.

The solid filter is preferably constructed of organic and inorganic fibers for capturing solid particles down to, a size of at least $1.5*10^{-5}$ m. The pressure reduction and the throttles are preferably designed to obtain a constant rate of flow of fire extinguishing medium from the second container.

The two containers should have, in addition to emergency discharge openings, being normally closed by safety membranes but which are electrically destructible, the destruction being triggered on command by the pilot. Other safety features include excess pressure monitoring devices, as well as filler openings. Smoke detectors should be provided and respond for signaling any smoke detection to the pilot to permit his triggering the fire extinguishing process.

DESCRIPTION OF THE DRAWINGS

While the specification concludes with claims particularly pointing out and distinctly claiming the subject matter which is regarded as the invention, it is believed that the invention, the objects and features of the invention and further objects, features, and advantages thereof will be better understood from the following description taken in connection with the accompanying drawings in which:

Proceeding now to the detailed description of the drawings, it is emphasized that the basic design concept of known fire protection and extinguishing equipment is maintained. There are two containers 1 and 2 for holding fire extinguishing media, the containers. The medium is pressurized to be liquified, but is characterized by the usual feature in that it evaporates, i.e. turns into the gaseous state under atmospheric pressure. The containers include also the usual filling equipment, studs 10, and safety features 11 to respond to excess pressure.

Figure 1:
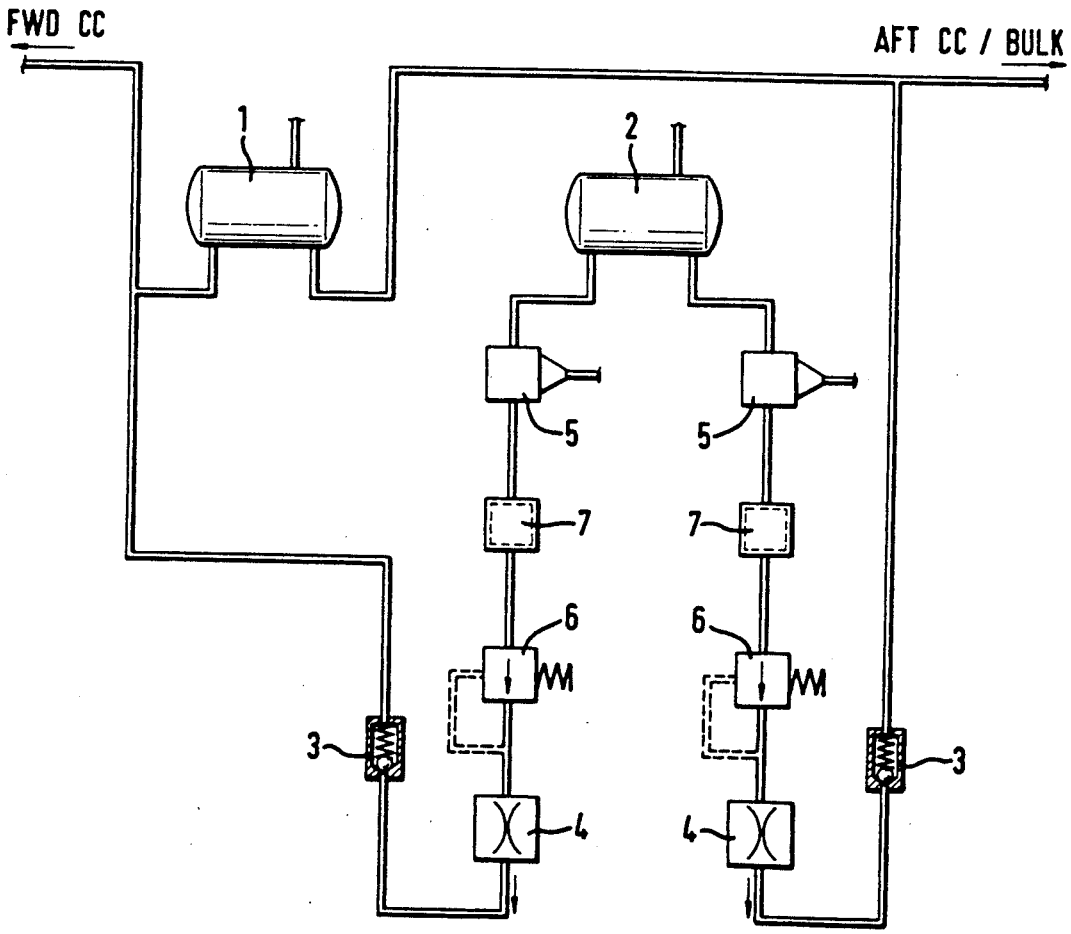
FIG. 1 is a block diagram of a fire extinguishing system in accordance, with the preferred embodiment of the present invention for practicing the best mode thereof.
Figure 2A:
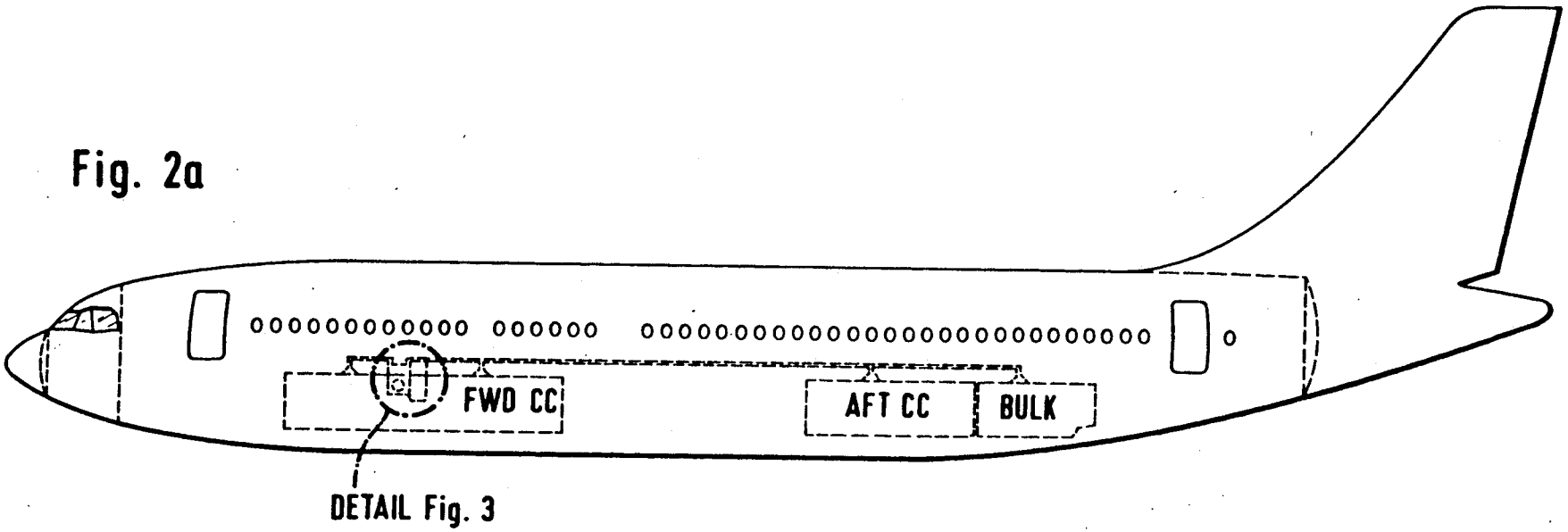
FIG. 2*a* is a side view of a passenger plane with schematic indications of cargo and baggage space, and indetifying the location of the fire extinguishing equipment within the aircraft.
Figure 2B:
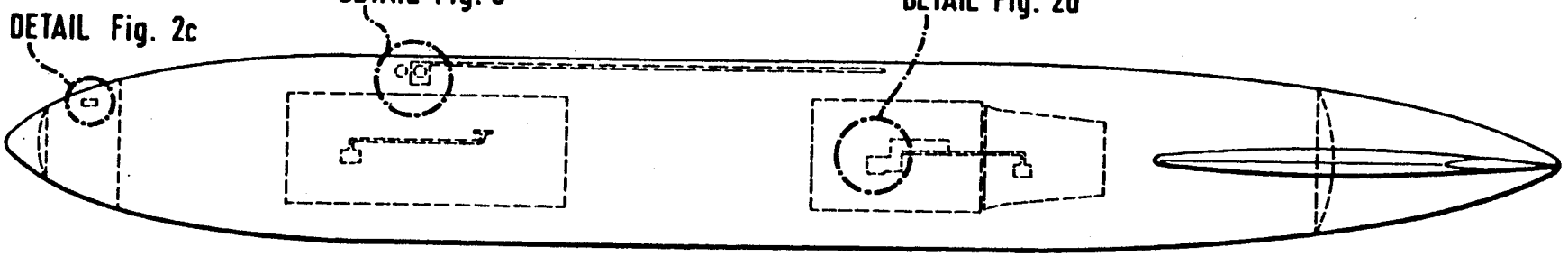
FIG. 2*b* is a top view of the fuselage of the aircraft shown in FIG. 2*a*, and whereby FIGS. 2*a* and 2*b* identify the location of details of FIGS. 2*c*, 2*d*, and 3.
Figure 2C:
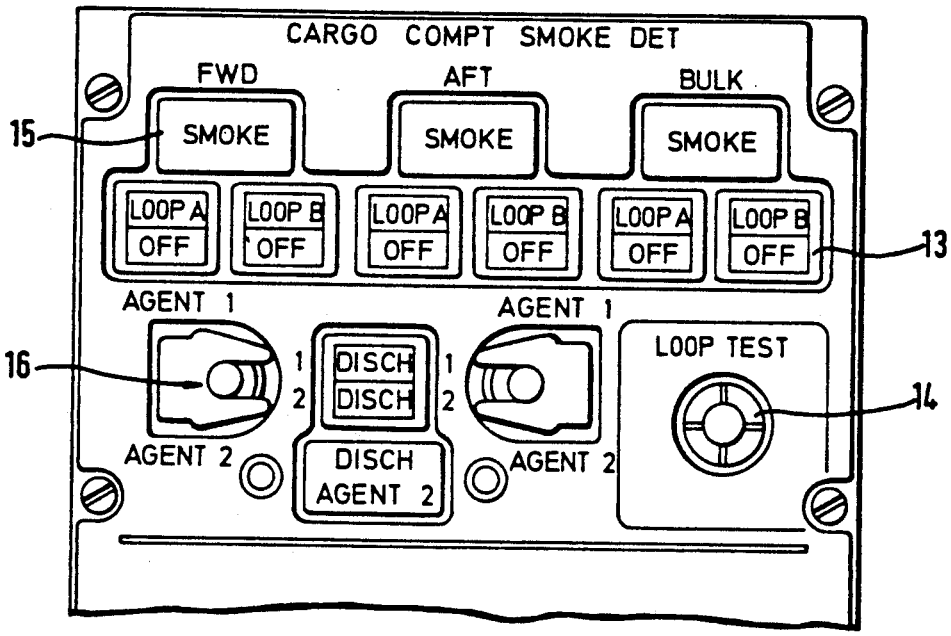
FIG. 2*c* illustrates a panel portion in the pilot's compartment, including the fire and smoke signalling and operating equipment.
Figure 2D:
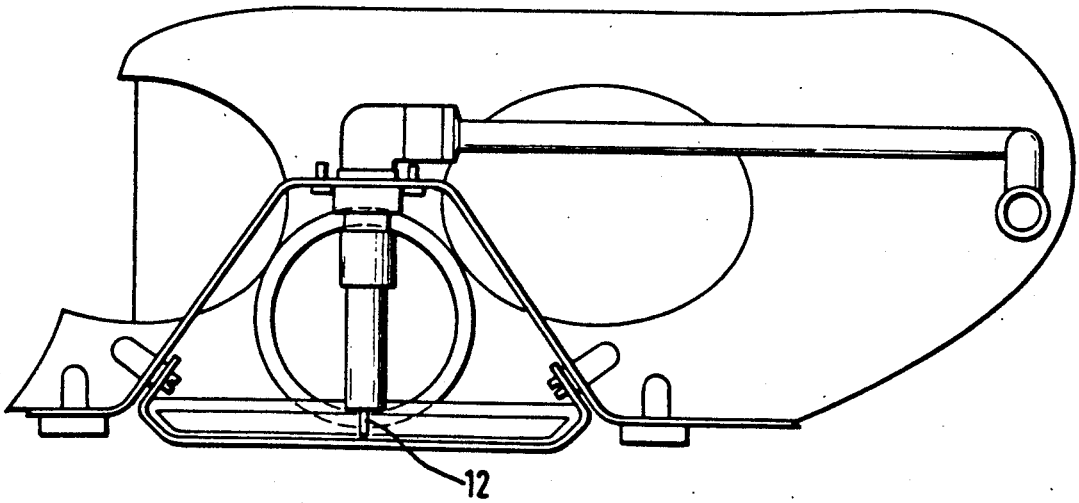
FIG. 2*d* illustrates a fire extinguishing nozzle of the system shown in FIG. 1 et seq.
Figure 3:
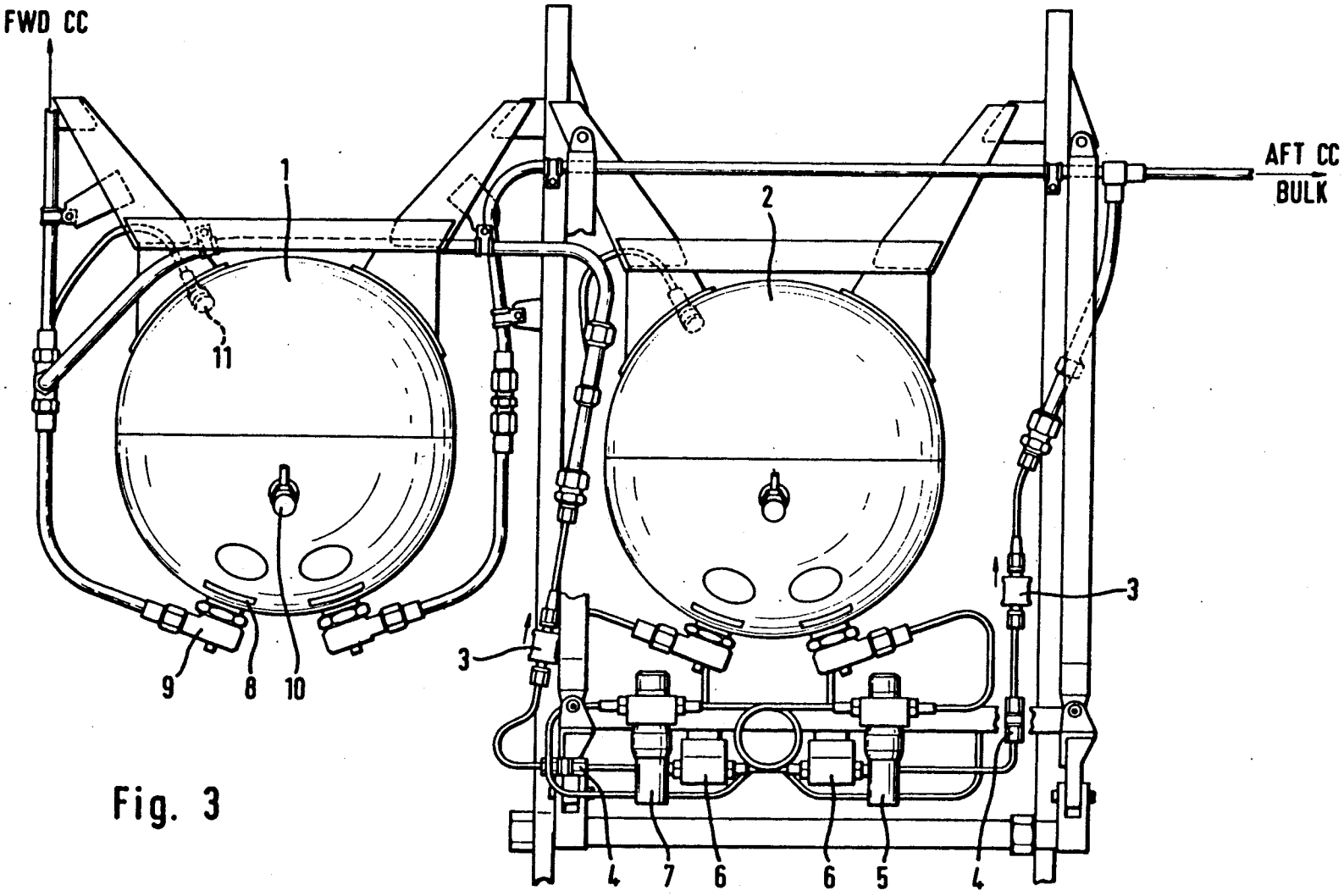
FIG. 3 shows a detail of the construction of the inventive fire extinguishing equipment.

The fire extinguishing operation is basically initialized and triggered by smoke detection in the freight and cargo compartment. This smoke detector triggers a signal indication 15 which is both, and optical and an acoustical signal in the cockpit. FIG. 2*c* shows particularly the portion of the panel in the cockpit by means of which the pilot can ascertain that smoke has been detected in one of the three compartments, the forward compartment (FWDC), the aft compartment (AFICC), and/or the bulk compartment (BULK).

The pilot operates a trigger switch 16 by means of which one of the safety membrane 8 in the first one of the containers 1 is electrically destroyed, e.g. through electric ignition of a rupturing charge. The selection of the membranes determines whether the fire to be extinguished is in the forward compartment or in the aft-/bulk compartments. Consequently, fire extinguishing liquid flows from the container 1 into the network of conduits and towards and into the various nozzles (such as 12) to extinguish the fire. This rapid action initiating operation is basically the same as in the prior art and that aspect is retained for the invention.

Now, following this operation, another switch 16 will in about 1 minute destroy the safety membrane 8 of the second fire extinguishing container, so that its content can flow into the same conduit network that was used following emptying of the container 1. However, before flowing into that conduit system and network, the evaporative medium flows from the container 2 first through a water adsorption filter 5, a solid particle filter 7, a pressure reducing stage 6, and a throttle 4, so that by combination of these elements, the rate of discharge from the container 2 is limited and, preferably, kept constant as to flow rate.

The fluid runs also through a one-way or check valve 3, and will enter the same conduit network by means of which the medium from container 1 was distributed. The one-way or check valve 3 prevents backflow of the fire extinguishing equipment during the first phase, i.e. flow of medium from container 1 into the special feeder systems, just described and leading from the container 2 to the common conduit system. The particular medium will not flow into the throttle device and backwards through the filters and so forth.

It is rather critical that the filtering, cleaning, and metering equipment for the medium, as it flows from container 2, is arranged immediately downstream from the container 2. It is believed to be that feature which avoids the danger of icing over of and in the fire extinguishing medium distributing system, notably the network of tubing and nozzles. The two fire extinguisher containers 1 and 2 are, for instance, next to the forward baggage compartments. Depending upon the location of the fire, the containers could be emptied in the forward freight and baggage compartment, or in the aft compartment, or in the bulk space for freight and cargo. In each of these should be at least two extinguishing nozzles provided.

The invention is not limited to the embodiments described above, but al changes and modifications thereof, not constituting departures from the spirit and scope of the invention are intended to be included.

we claim:

1. In a fire protection equipment for extinguishing fires in the cargo space of a vehicle, such as an aircraft, there being a first and a second container for extinguishing medium, the medium evaporating under atmospheric pressure, there being a distributing conduit system connected to the first one of said container and having discharge nozzles, the improvement comprising:

said second container being also connected to said conduit system through a series connection of a water adsorption fileter, a solid particle filter, a pressure reducing stage, a throttle, and a check valve.

2. The improvement as in claim 1, said solid particle filter including organic and in-organic fibers for filtering particles of at least $1.5*10^{-5}$ m.

3. The improvement as in claim 1, wherein said series circuit establishes a constant flow rate from the second container into the conduit system.

4. The improvement as in claim 1, including a safety membrane and means for destroying the membrane on command to initiate outflow of fire extinguishing medium from said containers.

* * * * *